United States Patent [19]

Iwasaki

[11] 4,145,628

[45] Mar. 20, 1979

[54] ROTATING ANODE X-RAY TUBE

[75] Inventor: Kenji Iwasaki, Yokohama, Japan

[73] Assignee: Tokyo Shibaura Electric Co., Ltd., Kawasaki, Japan

[21] Appl. No.: 793,432

[22] Filed: May 3, 1977

[30] Foreign Application Priority Data

May 10, 1976 [JP] Japan ..... 51-52973

[51] Int. Cl.[2] ..... H01J 35/10

[52] U.S. Cl. ..... 313/60; 313/330

[58] Field of Search ..... 313/60, 330

[56] References Cited

FOREIGN PATENT DOCUMENTS 2117956 11/1972 Fed. Rep. of Germany ..... 313/330

1219062 1/1971 United Kingdom ..... 313/60

*Primary Examiner*—Palmer C. Demeo

*Assistant Examiner*—Darwin R. Hostetter

*Attorney, Agent, or Firm*—Cushman, Darby & Cushman

[57] ABSTRACT

A rotating anode X-ray tube which comprises an anode facing a cathode hermetically secured to one end of an evacuated envelope, and wherein the anode has a rotary anode target fixed to a rotary shaft. The rotary anode target includes an electron-impact layer having a plane bombarded by electrons emitted from the cathode and a target base on which the electron-impact layer is laminated and the electron-impact layer and target base are joined together on a pair of horizontal faying surfaces substantially perpendicular to the axis of the rotary shaft.

2 Claims, 10 Drawing Figures

ROTATING ANODE X-RAY TUBE

BACKGROUND OF THE INVENTION

This invention relates to an X-ray tube, and more particularly to a rotating anode X-ray tube.

As is well known, a rotating anode X-ray tube comprises an electron-emitting cathode provided with a focussing electrode, a rotary shaft, and an anode fitted with a rotary anode target, and mounted on the rotary shaft to be bombarded by electrons issued from the cathode. The cathode and anode are hermetically sealed to the corresponding ends of an evacuated envelope in mutually facing relationship. The electron-impact surface of the rotary anode target is inclined to the axis of the rotary target, namely, that of the rotary shaft in order to send forth X-rays to the outside through an X-ray radiating window bored in the evacuated envelope.

The electron-impact surface of the rotary anode target is heated to high temperature by bombarded electrons. Therefore, the rotary target is formed, as a general rule, mainly of relatively inexpensive tungsten having a high melting point. However, tungsten having a high specific gravity undesirably renders a resultant rotaty target considerably heavy. To eliminate this drawback, an X-ray tube has been proposed in which molybdenum having a small specific gravity constitutes the base of a rotary target and an electron-impact layer of tungsten is laminated on the molybdenum target base. Such laminated rotary target can have a large heat capacity considering its weight. In recent years, however, customary practice is to prepare a target base from graphite having a low specific gravity and high melting point in order to provide a rotary target having a large heat capacity. In some cases, a graphite target base is joined with a molybdenum electron-impact layer. For reference, the main physical properties of tungsten (W), molybdenum (Mo) and graphite (C) are set forth in Table 1 below.

Table 1

| | W | Mo | C |
|---|---|---|---|
| Specific heat (cal/g/° C) | 0.032 | 0.061 | 0.18 |
| Thermal conductivity (cal/gm² ° C sec) | 0.48 | 0.35 | 0.3 |
| Linear expansion coefficient ($10^{-6}$/° C) | 4.3 | 4.9 | 3.5 to 5.0 |
| Melting point (° C) | 3,410 | 2,625 | >3,000 |
| Vapor pressure (mmHg at 1,500° C) | $1.93 \times 10^{-15}$ | $6 \times 10^{-9}$ | |
| Specific gravity | 18 | 10 | 1.6 to 1.7 |
| Atomic number | 74 | 42 | 14 |
| Oxidation temperature | about 300° C | about 200° C | |
| Heat radiation index ($\lambda = 6.65\mu$) | 0.435 at 1,750° C | 0.358 at 1,750° C | |

Hitherto, difficulties were encountered in laminating an electron-impact layer of tungsten or molybdenum on a target base of molybdenum or graphite with a sufficient bonding strength. For example, the prior art rotary target 10 was constructed, as shown in FIG. 1, by mounting an electron-impact layer 12 of tungsten having an inclined shoulder portion on a target base 14 of graphite having the corresponding inclined shoulder portion. In this case, the faying surfaces of both members 12, 14 included horizontal portions substantially perpendicular to the axis 16 of the rotary target, namely, that of a rotary shaft (not shown) and inclined portions. The faying surfaces of both members 12, 14 were ground and polished, and later laminated on each other under pressure at high temperature of about 1,800° C. with an adhesive paste of molybdenum or a mixture of molybdenum and ruthenium interposed therebetween. However, it was difficult to grind and polish the faying surfaces of both members 12, 14 so minutely as to leave no gap between the faying surfaces when both members 12, 14 were laminated on each other. Unless coincidence took place between the inclined angles of the shoulder portions of both members 12, 14, then a gap arose between the inclined portions or horizontal portions of both members 12, 14 or between the respective inclined portions and horizontal portions thereof. As the result, the above-mentioned paste was partly collected in the gap, eventually failing to provide a uniform bonding strength for an entire assembly of both members 12, 14. In the gap, therefore, adhesion between both members 12, 14 became imperfect, with the result that the electron-impact layer of tungsten and the target base of graphite readily peeled off from each other, and particularly at high temperatures the peeling occurred noticeably.

SUMMARY OF THE INVENTION

It is accordingly the object of this invention to provide a rotating anode X-ray tube including a rotary anode target, in which the base of the rotary target and an electron-impact layer are laminated on each other with a fully high bonding strength.

To this end, a preferred embodiment of this invention provides a rotary anode X-ray tube in which the faying surfaces of the electron-impact layer of a rotary target and the base thereof, that is, the underside of the electron-impact layer and the upper side of the target base are formed of horizontal planes substantially perpendicular to the axis of a rotary shaft. Obviously, the upper shoulder portion of the electron-impact layer of the rotary target is formed of an inclined electron-impact plane. As mentioned above, the faying surfaces of the electron-impact layer and target base contain no inclined plane, but are only formed of horizontal planes, thereby admitting of easy grinding and polishing work and preventing the occurrence of a gap when the electron-impact layer and target base are laminated on each other. Further advantages of this invention are that an adhesive paste is uniformly distributed over the mutually facing sides of both members to admit of thin firm bonding and in consequence the members do not peel off from each other even at high temperatures.

Other objects, features and advantages of this invention will become apparent as the description thereof preceeds when considered in connection with the accompanying drawings.

DETAILED DESCRIPTION OF THE PREFERRED EMBODIMENTS

Figure 1:
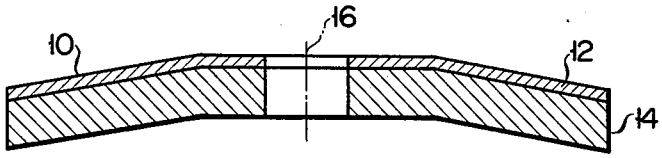
FIG. 1 (PRIOR ART)
FIG. 1 is a longitudinal sectional view of a rotary anode target of the prior art rotating anode X-ray tube.
Figure 2:
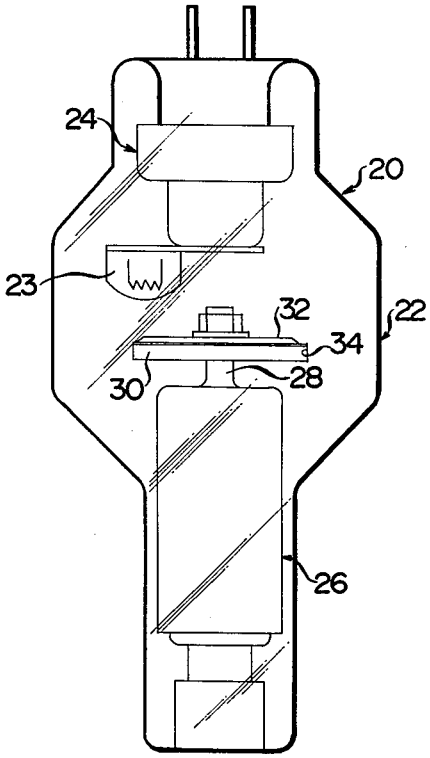
FIG. 2 is a schematic front view of a rotating anode X-ray tube embodying this invention.

As shown in FIG. 2, a rotating anode X-ray tube 20 according to a preferred embodiment comprises an evacuated envelope 22, a cathode 24 provided with an eccentrically positioned focussing electrode 23 and hermetically sealed to one end of the evacuated envelope 22, and an anode 26 hermetically sealed to the other end of the evacuated envelope 22 so as to face the cathode 24. The anode 26 is formed of a rotary shaft 28 rotating at a high speed of 3,000 to 15,000 r.p.m. and an anode target 30 mounted on the rotary shaft 28. Electrons emitted from the cathode 24 bombard on the electron-impact plane of the electron-impact layer 32 of the anode target 30 to be converted into X-ray. The electron-impact layer 32 is made of tungsten and laminated under pressure on a target base 34 of graphite.

Figure 3:
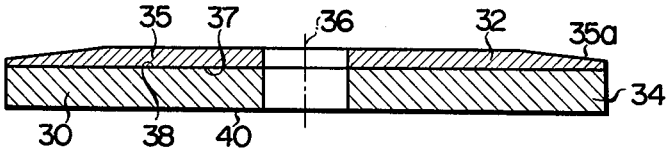
FIG. 3 is an enlarged longitudinal sectional view of a rotary anode target received in the X-ray tube of FIG. 2.
Figure 4:
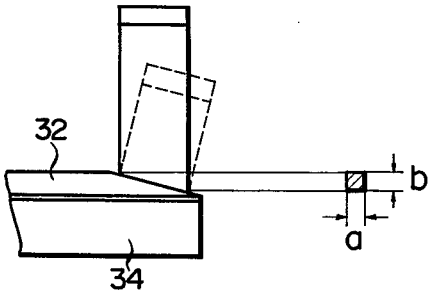
FIG. 4 presents a relationship between the rotary target and focus.

As shown in enlargement of FIG. 3, electron-impact layer 32 of the anode target 30 includes an upper surface 35 constituting an electron-impact plane, the upper surface 35 having an annular plane **35*a* inclined to the axis 36 of the rotary shaft, and a lower horizontal surface 37 substantially perpendicular to the axis 36 of the rotary shaft. The inclined plane 35*a* is intended to provide X-rays having a small focal length with a low electron density and is chosen to define an angle of 5 to 20°, generally about 12° with a horizontal plane. In contrast, the target base 34 has a pair of upper and lower horizontal surfaces 38, 40 substantially perpendicular to the axis 36 of the rotary shaft. A rotating anode X-ray tube 20 embodying this invention is characterized in that as seen from FIG. 3, the underside 37 of the electron-impact layer 32 and the upper side 38 of the target base 34** are formed horizontally flat alike.

With the X-ray tube 20 of this invention, the faying surfaces of the constituent members of the anode target 30, that is, underside 37 of the electron-impact layer 32 of tungsten and the upper side 38 of the target base 34 of graphite form, as described above, horizontal planes perpendicular to the axis 36 of the rotary shaft, thereby enabling the faying surfaces to be easily machined and suppressing the occurrence of a gap therebetween. Accordingly, the electron-impact layer 32 and target base 34 are tightly laminated on each other with an adhesive paste evenly distributed between the faying surfaces 37, 38 thereof, which in turn are adhered to each other with a great uniform bonding strength. Therefore, the electron-impact layer 32 does not peel off from the target base 34 even when the anode target 30 is heated to high temperatures.

The width "a" and height "b" of the practically used electron-impact layer 32 relative to the focal length "f" of X-rays emitted may be determined as shown in Table 2 below.

Table 2

| Focal length f mm of X-rays | Width a mm | Height b mm |
|---|---|---|
| $f < 0.8$ | $f(1^{+0.5}_{-0})$ | $\frac{a}{0.7}(1^{+0.5}_{-0})$ |
| $0.8 \leqq f \leqq 1.5$ | $f(1^{+0.4}_{-0})$ | $\frac{a}{0.7}(1^{+0.4}_{-0})$ |
| $1.5 < f$ | $f(1^{+0.3}_{-0})$ | $\frac{a}{0.7}(1^{+0.3}_{-0})$ |

To provide X-rays having a focal length of f = 1mm, the electron-impact layer 32 should have a width "a" of 1.0 to 1.4mm and a height "b" of 1.43 to 2.80mm. Where some tolerance is allowed, the electron-impact layer 23 well serves the purpose if it has a height of 2.2mm.

In any case, lamination of a thinnest possible electron-impact layer 32 prepared from tungsten having a large specific gravity on a target base 34 formed of graphite having a small specific gravity and large heat capacity can provide a light rotary anode target 30 having a large heat capacity and free from peeling.

For the object of this invention, it is possible to mount on the target base 34 the electron-impact layer 32 on which an annular inclined plane **35*a* has been formed in advance. Yet to cause the faying surfaces of the electron-impact layer 32 and target base 34 to be joined together with a great bonding strength, it is possible with this invention first to laminate the electron-impact layer 32 on the target base 34 and later form the annular inclined plane 35*a* on the electron-impact layer 32. In the former case, it is necessary to carry out centering or correct the inclination angle of the inclined plane 35*a* after the electron-impact layer 32 and target base 34 are joined together. Therefore, these members 32, 34 are previously prepared in a slightly larger size than actually required. The latter case enables a rotary anode to be provided easily and quickly with the inclined plane 35*a*** having a prescribed inclination angle.

Figure 5:
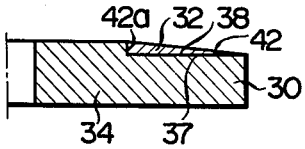
FIGS. 5 to 10 are longitudinal sectional views of the respective right half portions of various modifications of the rotary target included in the rotating anode X-ray tube of FIG. 2.

FIGS. 5 to 10 illustrate various modifications of a rotary anode target received in a rotating anode X-ray tube embodying this invention. Throughout these figures, the same parts as these of FIG. 3 are denoted by the same numerals. Referring to FIG. 5, an annular depression 42 is formed in the target base 34 of graphite. The electron-impact layer 32 of tungsten is received in the depression 42. In this case, the electron-impact layer 32 and target base 34 are joined together also in the shoulder portion **42*a* of the annular depression 42. Peeling which generally taken place in the vertical direction of the assembled mass of both members 32, 34 little affects the bonding strength of the assembled mass. The horizontally laminated planes 37, 38 each having a large surface area provide a substantially uniform great bonding strength. If the electron-impact layer 32 has a larger inner diameter than that of the shoulder portion 42*a* of the target base 34, or the shoulder portion itself is chamfered, then the electron-impact layer 32 and target base 34 are not joined together in the shoulder portion 42*a* of the depression 42. When formed in the annular depression 42, the electron-impact layer 32 of tungsten is reduced in size, providing a lighter rotary anode target 30** having a large heat capacity.

Figure 6:
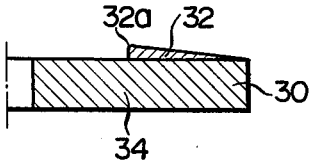

Further, if the electron-impact layer 32 is simply mounted, as shown in FIG. 6, on the upper surface of the target base 34 without providing the above-mentioned annular depression 42, then the rotary anode target 30 can be easily produced at low cost, because it is unnecessary to form the depression 42. In this case, however, the inner edge of the electron-impact layer 32 should preferably be rounded to avoid the occurrence of electric break-down.

Figure 7:
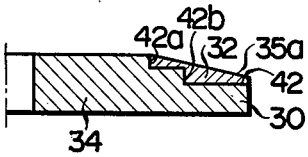

As shown in FIG. 7, where the annular inclined plane **35*a* of the electron-impact layer 32 sharply slopes downward, then the stepped formation of the faying surfaces of the electron-impact layer 32 and target base 34 will reduce the weight of the rotary anode target 30. In this case, too, the electron-impact layer 32 and target base 34 are laminated on each other mainly on the respective horizontal flat planes. The shoulder portions 42***a*, 42*b* of both members 32, 34 little render the prevention of the peeling thereof.

Figure 8:
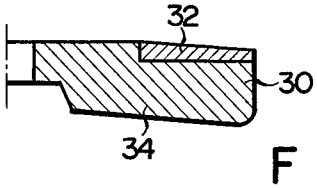
Figure 9:
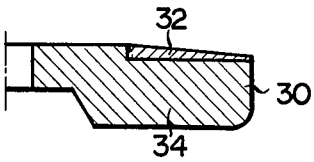
Figure 10:
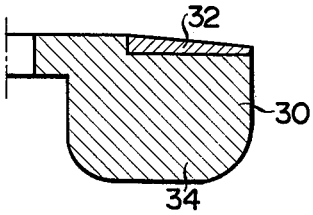

The underside 40 of the target base 34 need not be flat, but may be made convex as illustrated in FIGS. 8 to 10. A rotary anode target 30 whose target base 34 has such a convex underside 40 will have a large heat capacity and prominently radiate heat.

As previously described, the electron-impact layer 32 and target base 34 of a rotating anode X-ray tube embodying this invention are joined together mainly on the respective horizontal planes substantially perpendicular to the axis 36 of the rotary shaft with a great bonding strength and do not peel off from each other even at high temperatures. The faying surfaces of the electron-impact layer 32 and target base 34 well serve the purpose, provided the faying surfaces are mainly formed of horizontal flat planes. Even of the faying surfaces include vertical planes parallel with the axis 36 of the rotary shaft, it should not be considered to fall outside of the technical scope of this invention. Fundamentally, any horizontal faying surface should not include an inclined plane. If, however, the faying surfaces of the electron-impact layer 32 and target base 34 include an inclined plane which is formed simply to act as an escapement for mechanical work and consequently little affects the tight lamination of both members 32, 34, it is obviously included in this invention.

Tungsten may be mixed with rhenium or iron as a surface roughening inhibitor, and molybdenum with titanium for the similar purpose. In this case, the content of rhenium is chosen to be 5 to 15% by weight.

What is claimed is:

1. A rotating anode X-Ray tube comprising:

an evacuated envelope;

a cathode having an eccentrically disposed focusing electrode, said cathode being hermetically sealed to one end of the evacuated envelope; and an anode having a rotary shaft and an anode target mounted on the rotary shaft, the anode being hermetically sealed to the other end of the evacuated envelope so as to face the cathode, the anode target comprising a target base having a stepped annular depression formed on the very end portion of the upper side thereof, said depression having planes substantially perpendicular to the axis of the rotary shaft, and an annular electron-impact layer having a stepped underside corresponding to the stepped annular depression of the electron-impact layer, said impact layer being adhesively bonded to said perpendicular planes of the stepped annular depression.

2. The rotating anode X-ray tube according to claim 1, wherein the electron-impact layer is mainly prepared from tungsten, and the target base is mainly formed of graphite.

* * * * *